US008986022B2

(12) United States Patent
Dinh et al.

(10) Patent No.: US 8,986,022 B2
(45) Date of Patent: Mar. 24, 2015

(54) PIVOTING FACE RECEPTACLE

(71) Applicant: Thomas & Betts International, Inc., Wilmington, DE (US)

(72) Inventors: Cong T. Dinh, Collierville, TN (US); Bobby N. Norwood, Leoma, TX (US); Mark R. Drane, Germantown, TN (US)

(73) Assignee: Thomas & Betts International, LLC, Wilmington, DE (US)

( * ) Notice: Subject to any disclaimer, the term of this patent is extended or adjusted under 35 U.S.C. 154(b) by 36 days.

(21) Appl. No.: 13/791,030

(22) Filed: Mar. 8, 2013

(65) Prior Publication Data

US 2013/0344721 A1 Dec. 26, 2013

Related U.S. Application Data

(60) Provisional application No. 61/661,854, filed on Jun. 20, 2012.

(51) Int. Cl.

| | |
|---|---|
| ***H01R 13/52*** | (2006.01) |
| ***H01R 13/639*** | (2006.01) |
| ***H01R 24/78*** | (2011.01) |
| *H01R 103/00* | (2006.01) |

(52) U.S. Cl.

CPC ..... *H01R 13/5213* (2013.01); *H01R 13/6395* (2013.01); *H01R 24/78* (2013.01); *H01R 2103/00* (2013.01)

USPC ..... 439/131

(58) Field of Classification Search

CPC ..... H01R 36/04

USPC ..... 439/131, 142, 144, 534

See application file for complete search history.

(56) References Cited

U.S. PATENT DOCUMENTS

| | | | | | |
|---|---|---|---|---|---|
| 1,300,286 | A | * | 4/1919 | McKay | 200/51 R |
| 1,648,582 | A | * | 11/1927 | Dodge, Jr. | 191/12 R |
| 2,305,101 | A | * | 12/1942 | O'Brien | 439/4 |
| 2,441,643 | A | * | 5/1948 | Mickler | 200/51.12 |
| 2,652,546 | A | * | 9/1953 | Christner | 439/8 |
| 2,691,721 | A | * | 10/1954 | Bornhuetter | 362/430 |
| 2,866,956 | A | * | 12/1958 | Miller et al. | 439/131 |
| 3,972,579 | A | | 8/1976 | Kohaut | |
| 4,036,543 | A | * | 7/1977 | Taketomi | 439/8 |
| 4,372,629 | A | * | 2/1983 | Propst et al. | 312/223.6 |

(Continued)

FOREIGN PATENT DOCUMENTS

| | | | |
|---|---|---|---|
| JP | 5-211085 | * | 8/1993 |
| JP | 2013-45734 | * | 3/2013 |

*Primary Examiner* — Neil Abrams

(74) *Attorney, Agent, or Firm* — Snyder, Clark, Lesch & Chung, LLP

(57) ABSTRACT

A pivoting face receptacle may include a receptacle module. The receptacle module may include a hinge and a receptacle attached to the hinge. The receptacle is configured to pivot, about the hinge, from a retracted position in which a face of the receptacle is parallel to a front of the receptacle module, to an extended position in which the face of the receptacle is substantially perpendicular to the front the receptacle module and protrudes from the face of the receptacle module. The pivoting face receptacle may also include a receptacle housing. The receptacle housing, having a front affixed to a rear of the receptacle module, may include a plurality of contacts on exterior faces of the receptacle housing. The receptacle housing may be configured to receive the receptacle into a space enclosed by the receptacle housing when the receptacle is in the retracted position.

21 Claims, 10 Drawing Sheets

(56) References Cited

U.S. PATENT DOCUMENTS

| | | | | | |
|---|---|---|---|---|---|
| 4,611,887 | A * | 9/1986 | Glover et al. | 385/71 |
| 4,625,259 | A | 11/1986 | Krechmer et al. | |
| 4,743,999 | A * | 5/1988 | Hames | 361/56 |
| 5,122,069 | A * | 6/1992 | Brownlie et al. | 439/131 |
| 5,144,290 | A * | 9/1992 | Honda et al. | 345/156 |
| 5,195,900 | A * | 3/1993 | Kumagai et al. | 439/131 |
| 5,231,562 | A * | 7/1993 | Pierce et al. | 361/832 |
| 5,572,402 | A * | 11/1996 | Jeong | 361/679.31 |
| 5,575,668 | A * | 11/1996 | Timmerman | 439/131 |
| 5,598,319 | A * | 1/1997 | Lee | 361/679.33 |
| 5,755,582 | A * | 5/1998 | Charlton | 439/131 |
| 5,967,836 | A * | 10/1999 | Bailey | 439/534 |
| 6,028,267 | A | 2/2000 | Byrne | |
| 6,059,584 | A | 5/2000 | Mareno | |
| 6,085,667 | A * | 7/2000 | Gevaert et al. | 108/50.02 |
| 6,089,886 | A | 7/2000 | Mareno | |
| 6,127,630 | A * | 10/2000 | McKenzie et al. | 174/58 |
| 6,273,735 | B1 * | 8/2001 | Johnson et al. | 439/131 |
| 6,290,518 | B1 | 9/2001 | Byrne | |
| 6,300,570 | B1 * | 10/2001 | Lai | 174/67 |
| 6,329,595 | B1 * | 12/2001 | Roberts | 174/53 |
| 6,366,450 | B1 * | 4/2002 | Janicek | 361/679.41 |
| 6,478,587 | B2 * | 11/2002 | Sharples | 439/131 |
| 6,544,069 | B1 * | 4/2003 | Enriquez et al. | 439/534 |
| 6,683,786 | B2 * | 1/2004 | Yin et al. | 361/679.4 |
| 6,748,707 | B1 * | 6/2004 | Buchalter et al. | 52/220.1 |
| 6,780,038 | B1 | 8/2004 | Huang | |
| 6,897,379 | B1 * | 5/2005 | Hsiao | 174/53 |
| 6,942,502 | B2 * | 9/2005 | Sharples | 439/131 |
| 6,999,695 | B2 * | 2/2006 | Ueda | 399/90 |
| 7,042,715 | B2 * | 5/2006 | Lin et al. | 361/679.4 |
| 7,094,091 | B2 * | 8/2006 | Grzegorzewska et al. | 439/354 |
| 7,200,002 | B2 * | 4/2007 | Peng et al. | 361/679.4 |
| 7,207,523 | B2 * | 4/2007 | Callahan et al. | 244/118.6 |
| 7,264,514 | B2 | 9/2007 | Hsu et al. | |
| 7,296,775 | B2 * | 11/2007 | Mayer | 248/349.1 |
| 7,364,443 | B1 * | 4/2008 | McGinnis et al. | 439/131 |
| 7,404,298 | B2 * | 7/2008 | Kim et al. | 62/126 |
| 7,435,091 | B1 * | 10/2008 | Cruz | 439/18 |
| 7,484,689 | B2 * | 2/2009 | Musial et al. | 244/114 R |
| 7,540,748 | B2 * | 6/2009 | Tracy et al. | 439/131 |
| 7,540,768 | B1 * | 6/2009 | Wang | 439/536 |
| 7,771,216 | B2 * | 8/2010 | Grems et al. | 439/131 |
| 7,771,239 | B1 | 8/2010 | Hsiao | |
| 7,837,483 | B2 * | 11/2010 | Haut et al. | 439/131 |
| 7,874,869 | B2 * | 1/2011 | Chern et al. | 439/544 |
| 7,901,224 | B1 * | 3/2011 | Black et al. | 439/142 |
| 7,934,932 | B1 | 5/2011 | Lee et al. | |
| 7,967,616 | B1 | 6/2011 | Lee et al. | |
| 7,999,419 | B2 * | 8/2011 | Drane et al. | 307/326 |
| 8,007,295 | B2 | 8/2011 | Lin | |
| 8,057,243 | B2 | 11/2011 | Lee et al. | |
| 8,128,184 | B2 * | 3/2012 | Allard et al. | 312/405.1 |
| 8,277,233 | B2 * | 10/2012 | Su | 439/131 |
| 8,348,683 | B2 * | 1/2013 | Row | 439/131 |
| 8,563,883 | B1 * | 10/2013 | Flegel | 200/50.02 |
| 8,784,130 | B2 * | 7/2014 | Scott et al. | 439/517 |
| 8,854,828 | B2 * | 10/2014 | Fan | 361/755 |
| 2002/0021551 | A1 * | 2/2002 | Kashiwagi | 361/683 |
| 2009/0029577 | A1 | 1/2009 | Grems et al. | |
| 2010/0124849 | A1 * | 5/2010 | Winstanley et al. | 439/620.21 |
| 2013/0027856 | A1 * | 1/2013 | Tai et al. | 361/679.01 |
| 2013/0058056 | A1 * | 3/2013 | Fan | 361/749 |
| 2013/0344721 | A1 * | 12/2013 | Dinh et al. | 439/131 |
| 2014/0127935 | A1 * | 5/2014 | Scott et al. | 439/517 |

* cited by examiner

PIVOTING FACE RECEPTACLE

RELATED APPLICATION

This application claims priority under 35 U.S.C. §119 based on U.S. Provisional Patent Application No. 61/661,854 filed Jun. 20, 2012, the disclosure of which is incorporated by reference herein in its entirety.

BACKGROUND INFORMATION

Receptacles are usually installed in walls, for electrically connecting alternating current power supplies to power plugs. Although different types of receptacles can have different configurations, many receptacles still receive a plug at an orientation that is perpendicular to the surface of the wall. This configuration sometimes interferes with placement of furniture and can lead to gaps between the furniture and the wall, as the cord attached to the plug has to bend 90 degrees behind a desk, a bed, a cabinet, a dresser, etc.

BRIEF DESCRIPTION OF THE DRAWINGS

The accompanying drawings, which are incorporated in and constitute a part of this specification, illustrate one or more embodiments described herein and, together with the description, explain the embodiments. In the drawings.

DETAILED DESCRIPTION OF PREFERRED EMBODIMENTS

The following detailed description refers to the accompanying drawings. The same reference numbers in different drawings may identify the same or similar elements.

As described herein, a pivoting face receptacle includes a female plug that can rotate 90 degrees. Such a pivoting face receptacle has many applications. When the pivoting face receptacle is mounted in a wall, the female plug of the pivoting face receptacle can be pivoted. This eliminates the cable bend of the cord plugged into the pivoting face receptacle and prevents the cord from obstructing furniture placement. When the pivoting face receptacle is mounted within a while-in-use electrical box, the female plug of the pivoting face receptacle eliminates the cable bend inside the while-in-use electrical box. Accordingly, the cover of the electrical box can be made unobtrusive.

Figure 1:
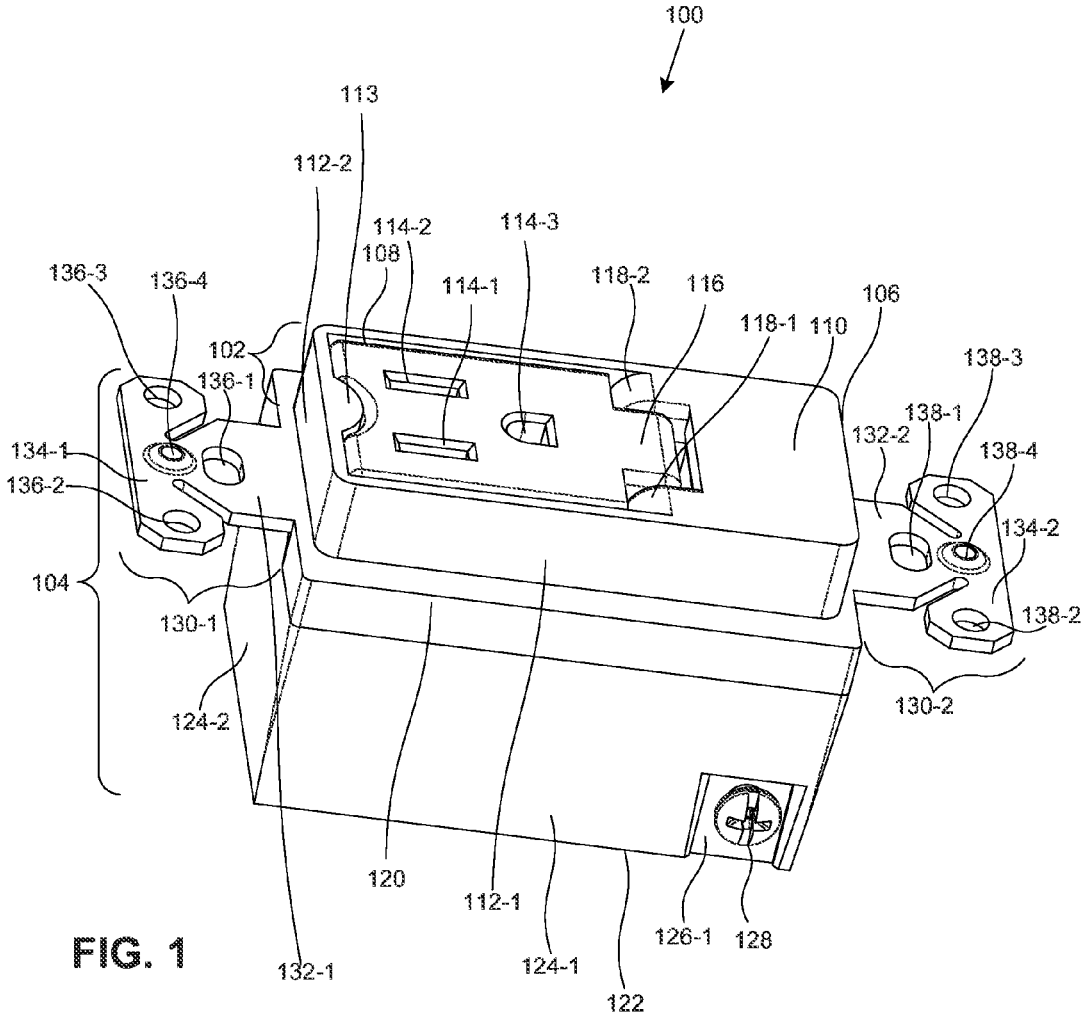
FIG. 1 is an isometric perspective front/side view of an exemplary pivoting face receptacle in a closed configuration according to one implementation.

FIG. 1 is an isometric perspective front/side view of an exemplary pivoting face receptacle 100 in a closed configuration according to one implementation. As shown, pivoting face receptacle 100 includes receptacle module 102 and receptacle housing 104. In one implementation, receptacle module 102 is rectangular in shape, and the bottom of receptacle module 102 is affixed to or joined to the top of receptacle housing 104.

Figure 10:
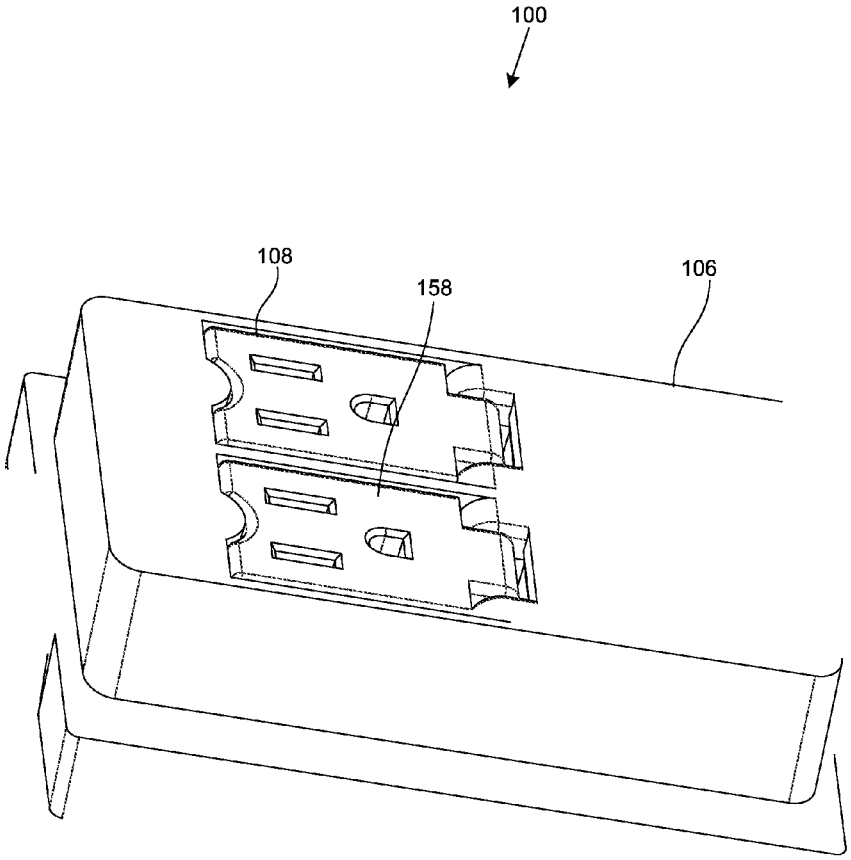
FIG. 10 is an isometric perspective front/side view of an exemplary pivoting face receptacle in a closed configuration according to another implementation.

Receptacle module 102 includes receptacle frame 106 and female plug 108. Receptacle frame 106 provides a support structure in which female plug 108 can be placed and pivoted. In another implementation, receptacle frame 106 may provide a support structure in which multiple pivoting female plugs are placed therein (see female plugs 108 and 158 in FIG. 10), such that the the female plugs can pivot about one axis. Female plug 108 may include a receptacle for receiving a male plug. Depending on the implementation, female plug 108 may receive one of many types of plugs (e.g., 3-prong plug, 2-prong plug, etc.).

Receptacle frame 106 includes a side wall 112-1, top wall 112-2, side wall 112-3 (not shown in FIG. 1), and a base 110. Walls 112 and base 110 surround a box-like space, into which female plug 108 is placed in the closed configuration (the configuration in which female plug 108 is not pivoted relative to the front face of receptacle module 102). Top wall 112-2, at its center, includes a bump 113 that protrudes slightly into the space defined by walls 112.

Female plug 108 is shaped to fit into the space formed by walls 112. The top portion of female plug 108 is shaped to have ridges 206-1 and 206-2 (see FIG. 2) such that the top portion accommodates/receives bump 113.

Female plug 108 includes contact holes 114-1, 114-2, and 114-3 for receiving prongs of a male plug and providing electrical paths from the prongs to wires/other portions of pivoting face receptacle 100. Although female plug 108 is illustrated as having three holes 114, in other implementations, receptacle frame 106 may include two holes for receiving other types of plugs.

With female plug 108 in the space formed by walls 112 and base 110, near the interface between female plug 108 and base 110 of receptacle frame 06, female plug 108 and base 110 include a hinge portion 116 and hinge/shoulder portions 118-1 and 118-2, respectively. Hinge portions 116, 118-1 and 118-2 form a hinge, about which female plug 108 can be pivoted.

Receptacle housing 104 includes front portion 120 and rear portion 122. Coupled together, front portion 120 and rear portion 122 form a rectangular, block-like structure. The block-like structure, and therefore, receptacle housing 104, includes side wall 124-1, top wall 124-2 (perpendicular to side wall 124-1), side wall 124-3 (not shown in FIG. 1), and bottom wall 124-4 (not shown in FIG. 1).

Front portion 120 partially covers the front of receptacle housing 104 (a portion not covered by receptacle module 102). Front portion 120 extends beyond the top of receptacle housing 104 as a top flange 130-1 and beyond the bottom of receptacle housing 104 as a bottom flange 130-2. Flanges 130-1 and 130-2 may be used to couple/affix pivoting face receptacle 100 to another device/component (e.g., an electrical box), to a surface (e.g., a wall), or to pass a screw or bolt for coupling other components.

Figure 4:
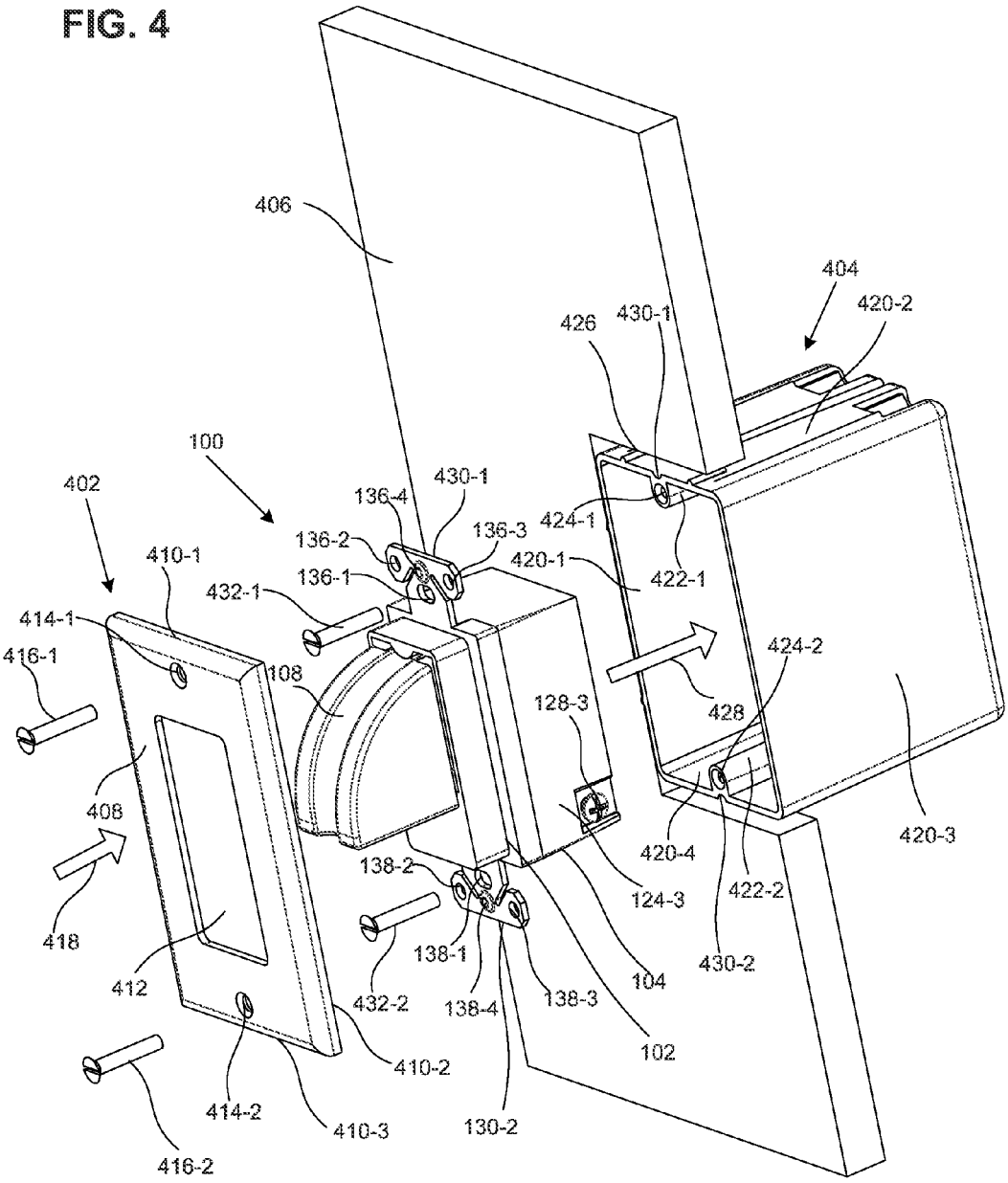
FIG. 4 is an exploded view of the pivoting face receptacle, an electrical box, and a wall in which the pivoting face receptacle and the electrical box are installed according to one implementation.

Flange 130-1 includes a support 132-1 and a fan 134-1. Support 132-1 includes a hole 136-1 though which a screw may be inserted to couple receptacle housing 104 (and therefore pivoting face receptacle 100) to an electrical box. Support 132-1 extends away from housing 104 into fan 134-1 that includes holes 136-2, 136-3 and 136-4. Holes 136-2 and 136-3 are spaced symmetrically about the center of fan 134-1. Screws may be inserted through holes 136-2 and 136-3 and into a wall to fix/install pivoting face receptacle 100 to the wall. Hole 136-4 is for passing a screw there through and coupling a face plate to pivoting face receptacle 100 (FIG. 4).

Flange 130-2 includes a support 132-2 and fan 134-2. Support 132-2 includes a hole 138-1 through which a screw may be inserted to couple receptacle housing 104 (and therefore pivoting face receptacle 100) to an electrical box. Support 132-2 extends away from housing 104 into fan 132-2 that includes holes 138-2, 138-3, and 138-4. Holes 138-2 and 138-3 are spaced symmetrically about the center of fan 134-2. Screws may be inserted through holes 138-2 and 138-3 and into a wall to fix/install pivoting face receptacle 100 to the wall. Hole 138-4 is for passing a screw there through and coupling a face plate to pivoting face receptacle 100 (FIG. 4).

As mentioned above, receptacle housing 104 includes side wall 124-1, top wall 124-2, side wall 124-3, and bottom wall 124-4. As shown in FIG. 1, side wall 124-1 includes, near the bottom and rear of receptacle housing 104, indentation 126-1 for accommodating the head of a contact screw 128-1. Contact screw 128-1 is inserted into receptacle housing 104 in the area of indentation 126-1. Contact screw 128-1 is electrically coupled to a contact within contact hole 114-1 (or alternatively, contact hole 114-2 or 114-3), via a conducting wire and/or another type of conducting path inside receptacle housing 104.

Figure 2:
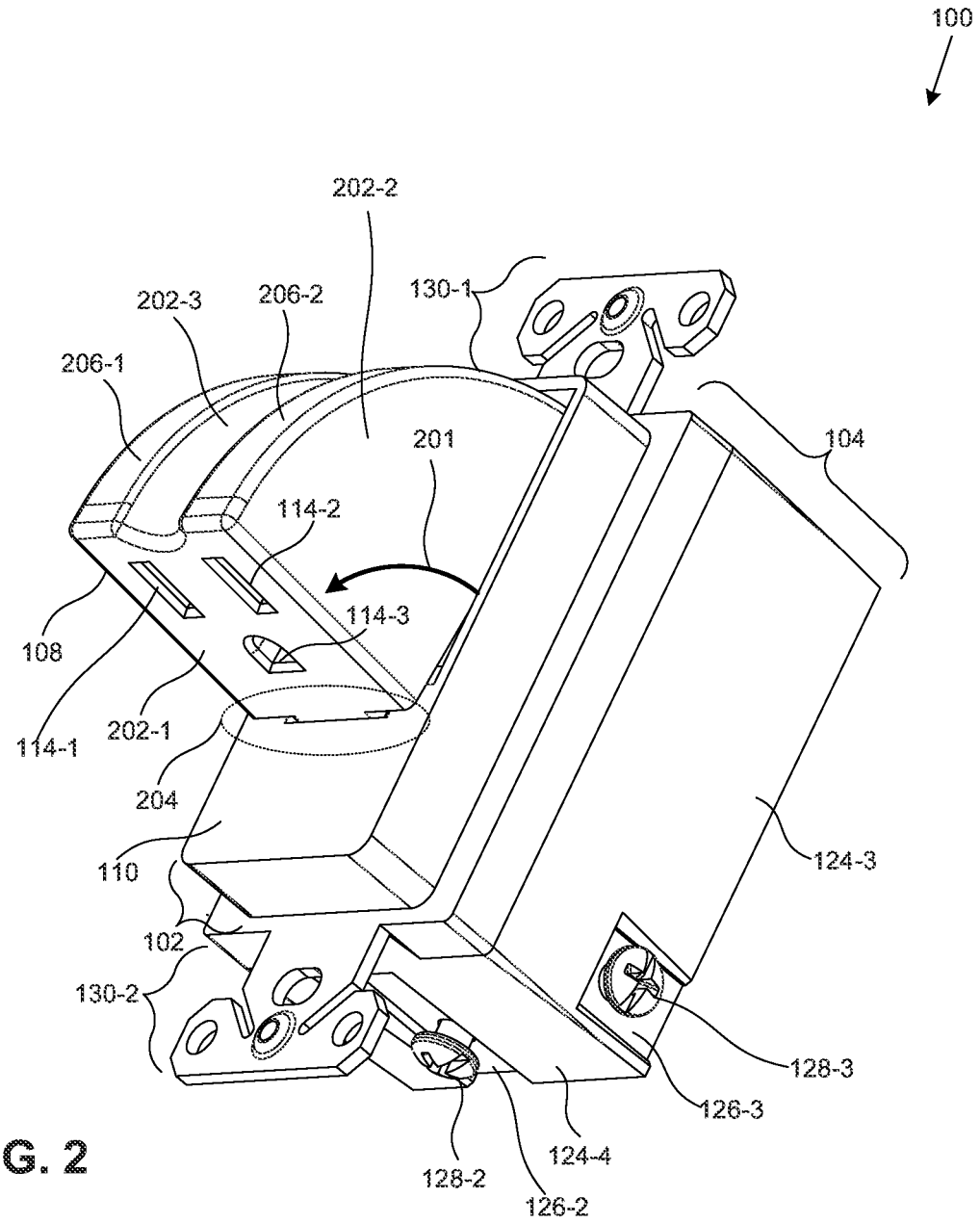
FIG. 2 is an isometric perspective bottom/side view of the pivoting face receptacle in an open configuration.

FIG. 2 is an isometric perspective bottom/side view of pivoting face receptacle 100 in an open configuration. In FIG. 2, a number of parts/portions of pivoting face receptacle 100 are not labeled for simplicity. Because FIG. 2 is a view of pivoting face receptacle 100 from a different perspective than that in FIG. 1, FIG. 2 shows a number of features that are not illustrated in FIG. 1.

As discussed above, hinge portion 116 of female plug 108 and hinge portions 118-1 and 118-2 form a hinge. The approximate area of the hinge is shown as area 204. To have pivoting face female plug 108 in the open position, female plug 108 may be pulled from the planar position illustrated in FIG. 1 and rotated about pivot area 204 in the direction of arrow 201. Once in the open position, front face 202-1 of female plug 108 is approximately perpendicular to the front face of receptacle module 102.

In FIG. 2, female plug 108 is shown to include front face 202-1, side surface 202-2, and arcing top surface 202-3. Although not shown in FIG. 2, female plug 108 may also include side surface 202-4 (parallel to surface 202-2 and not shown in FIG. 2) and a bottom surface 202-5 (not shown in FIG. 2). Surfaces 202-1 though 202-5 enclose a pie/wedge-like volume of space of female plug 108.

As further shown in FIG. 2, arcing surface 202-3 includes two ridges 206-1 and 206-2, at the outer edges (of surface 202-3) near surfaces 202-4 and 202-2, respectively. Ridges 206-1 and 206-2 are shaped such that arcing surface 202-3 fits in to the space formed by top wall 112-2 (see FIG. 1). Bump 113 on the top wall 112-2 and ridges 206-1 and 206-2 prevent lateral displacement as female plug 108 pivots out of the space enclosed by walls 112 and base 110.

FIG. 2 also shows side wall 124-3 and bottom wall 124-4 of receptacle housing 104. As shown, near the corner where bottom wall 124-4 and side wall 124-3 adjoin, side wall 124-3 includes an indentation 126-3 for accommodating the head of contact screw 128-3. Contact screw 128-3 is electrically coupled to a contact within contact hole 114-2 via a wire and/or another type of conducting path inside receptacle housing 104.

Bottom wall 124-4 is shown as including indentation 126-2, near where wall 124-4 adjoins a rear wall 124-5 (not shown), toward the center of bottom wall 124-4. Indentation 126-2 may accommodate the head of contact screw 128-2. Contact screw 128-2 is electrically coupled to a contact within contact hole 114-3 via a wire and/or another type of conducting path inside receptacle housing 104.

Figure 3:
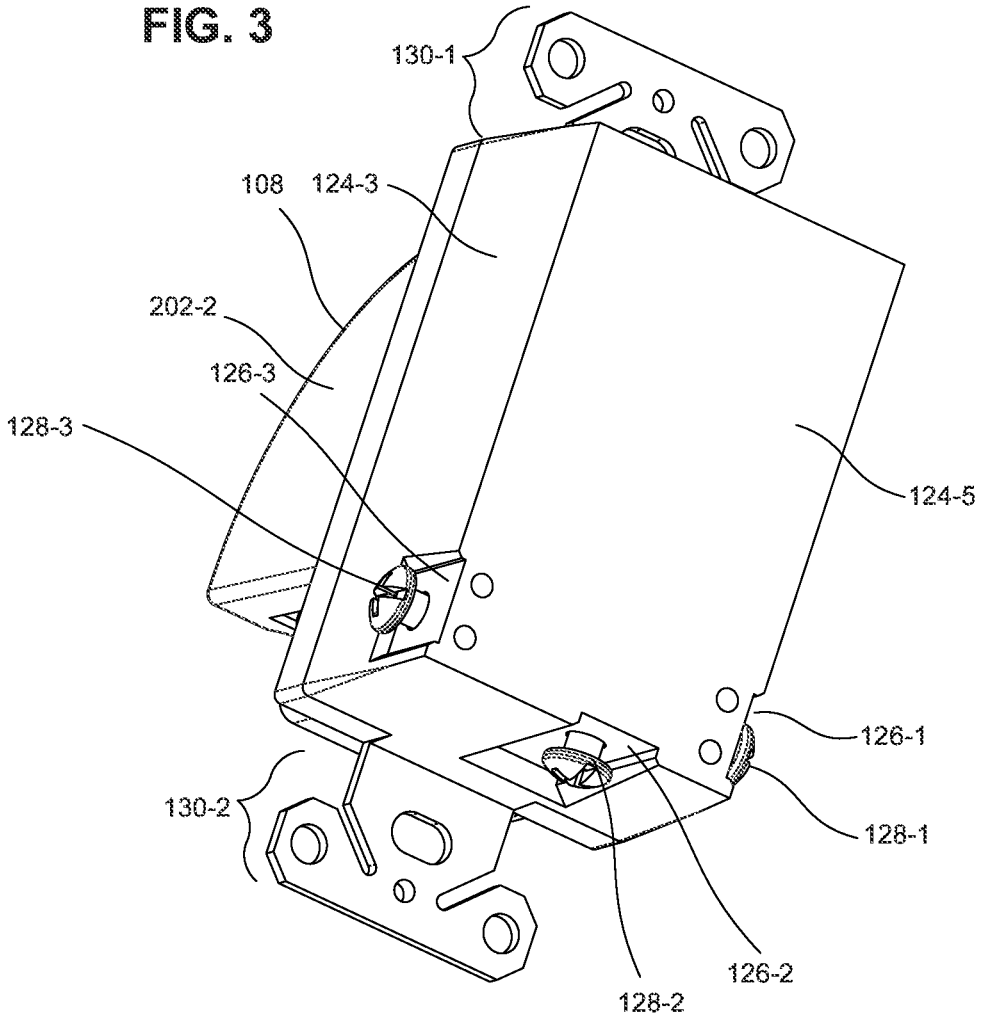
FIG. 3 is an isometric perspective bottom/rear view of the pivoting face receptacle in the open configuration.

FIG. 3 is an isometric perspective bottom/rear view of pivoting face receptacle 100 in the open configuration. FIG. 3 shows rear wall 124-5, which is not shown in FIGS. 1 and 2. In addition, FIG. 3 shows all three contact screws 128-1, 128-2, and 128-3 in corresponding indentations, 126-1, 126-2, and 126-3, respectively.

FIG. 4 is an exploded view of a face plate 402, pivoting face receptacle 100, an electrical box 404, and a wall 406 in which pivoting face receptacle 100 and electrical box 404 are installed according to one implementation. When assembled, face plate 402, pivoting face receptacle 100, electrical box 404, and wall 406 appear similar to a typical electrical outlet, except that the socket/receptacle can be pivoted.

Face plate 402 includes a front panel 408, top wall 410-1, side wall 410-2, bottom wall 410-3, and side wall 410-4 (not shown in FIG. 4). Walls 410 are perpendicular to front panel 408. Walls 410 are of sufficient height to accommodate the extent to which front portion 120 of receptacle housing 104 edges/protrudes out from wall 406, such that when face plate 402, pivoting face receptacle 100, and electrical box 404 are installed on wall 406, face plate 402 covers receptacle housing 104 with little or no spacing between the edges of walls 410 and wall 406.

Front panel 408 includes window 412 in its center, top hole 414-1 near top wall 410-1 and bottom hole 414-2 near bottom wall 410-2. Window 416 is sufficiently large enough to pass receptacle module 102 there through when face plate 402 is moved in the direction to arrow 418 to cover receptacle housing 104 and to abut wall 406 during an assembly. During the assembly, top hole 414-1 and bottom hole 414-2 may pass screws 416-1 and 416-2 there through, respectively.

Electrical box 404 includes a side wall 420-1, top wall 420-2, side wall 420-3, and bottom wall 420-4. Walls 420 and a rear panel 420-5 (FIG. 5) enclose a space to receive receptacle housing 104. As shown in FIG. 4, top wall 420-2 includes a tubular portion 422-1 attached thereto on the middle of its interior surface, running height-wise in the direction of arrow 428. Similarly, bottom wall 420-4 includes tubular portion 422-2 attached thereto on the middle of its interior surface, running height-wise in the direction of arrow 428. Tubular portions 422-1 and 422-2 include holes 424-1 and 424-2, respectively, for receiving screws 416-1 and 416-2, respectively. At the middle of exterior surface of top wall 420-2, a semicircular groove 430-1 is height-wise, as does a semicircular groove 430-2 at the middle of exterior surface of bottom wall 420-4.

When face plate 402, pivoting face receptacle 100, and electrical box 404 are being installed on wall 406, a rectangular hole 426 may be made on wall 406 for inserting electrical box 404 therein. Electrical wires may be run through electrical box 404 and attached to contact screws 128. Thereafter, pivoting face receptacle 100 may be placed into electrical box 404, with holes 136-1 and 138-1 of flanges 130 of receptacle 100 being aligned to holes 424-1 and 424-2 of tubular portions 422-1 and 422-2 of electrical box 404, respectively. Screw 432-1 may pass through hole 136-1 and into hole 424-1 (partially), and screw 432-2 may pass through hole 138-1 and into hole 424-2. Screws 432 may secure pivoting face receptacle 100 to electrical box 404. Electrical box 404, with pivoting face receptacle 100 attached thereto, may then be inserted into rectangular hole 426 of wall 406. Additional screws (not shown in FIG. 4) may be run through holes 136-2, 136-3, 138-2, and 138-3 to secure pivoting face receptacle 100 to wall 406, and therefore, electrical box 404 to wall 406, by the virtue of electrical box 404 having been attached to pivoting face receptacle 100 via screws 432.

Figure 5:
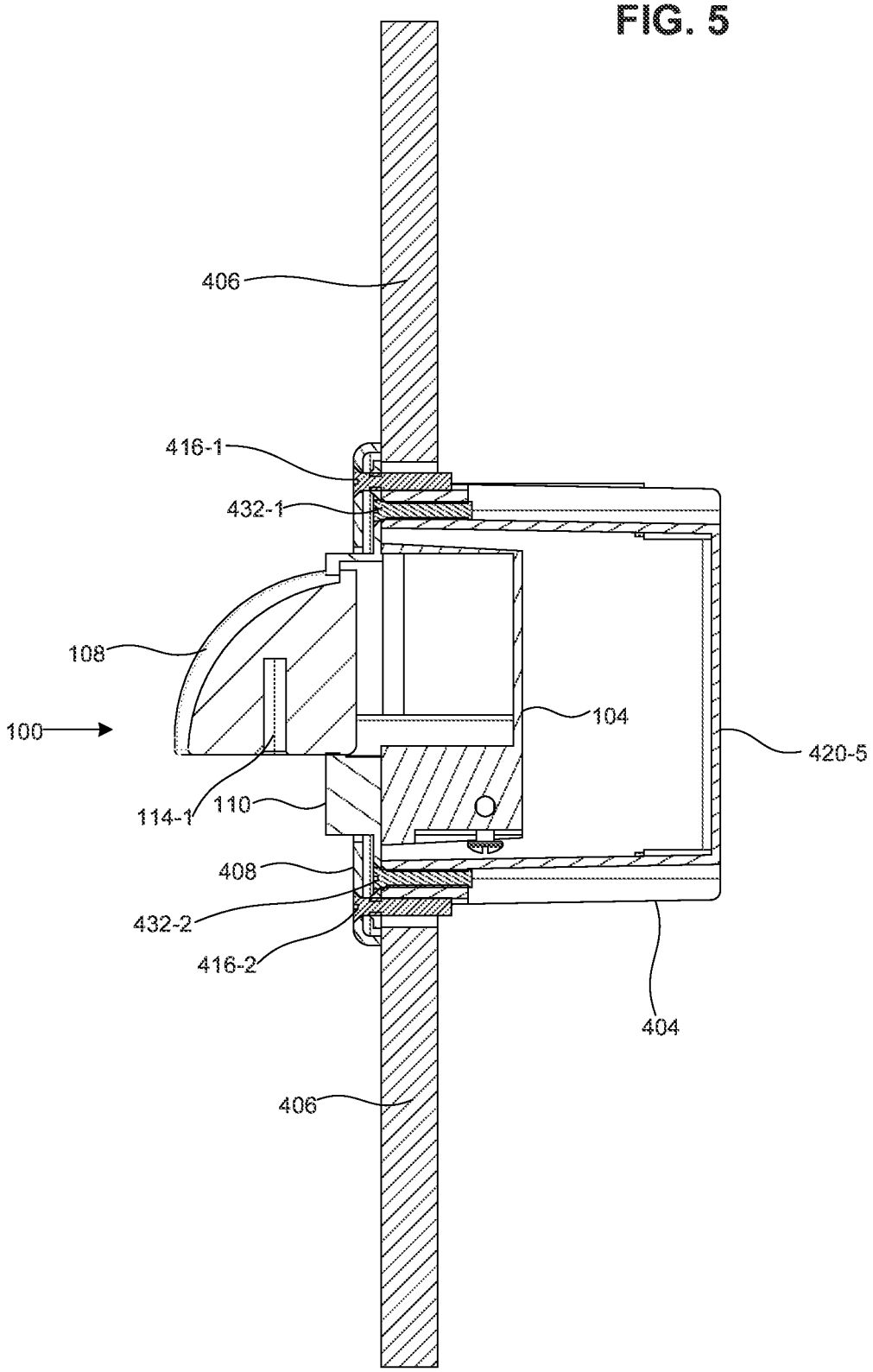
FIG. 5 is a cross-sectional side view of the pivoting face receptacle, the electrical box, and the wall in which the pivoting face receptacle and the electrical box are installed.

After securing pivoting face receptacle 100 and electrical box 404 to wall 406, face plate 402 may be placed over pivoting face receptacle 100, with receptacle module 108 passing through window 412 of face plate 402, and with holes 414-1 and 414-2 of face plate 402 being aligned to holes 136-4 and 138-4 of flanges 130, respectively. Screw 416-1 may then be inserted though holes 414-1 to secure face plate 402 against flange 130-1 via hole 136-4. Similarly, screw 416-2 may be inserted through holes 414-2 to further secure face plate 402 against flange 130-2 via hole 138-4. FIG. 5 shows a cross-sectional side view of face plate 402, pivoting face receptacle 100, electrical box 404, and wall 406 after pivoting face receptacle 100 and electrical box 420 are installed in wall 406.

Figure 6:
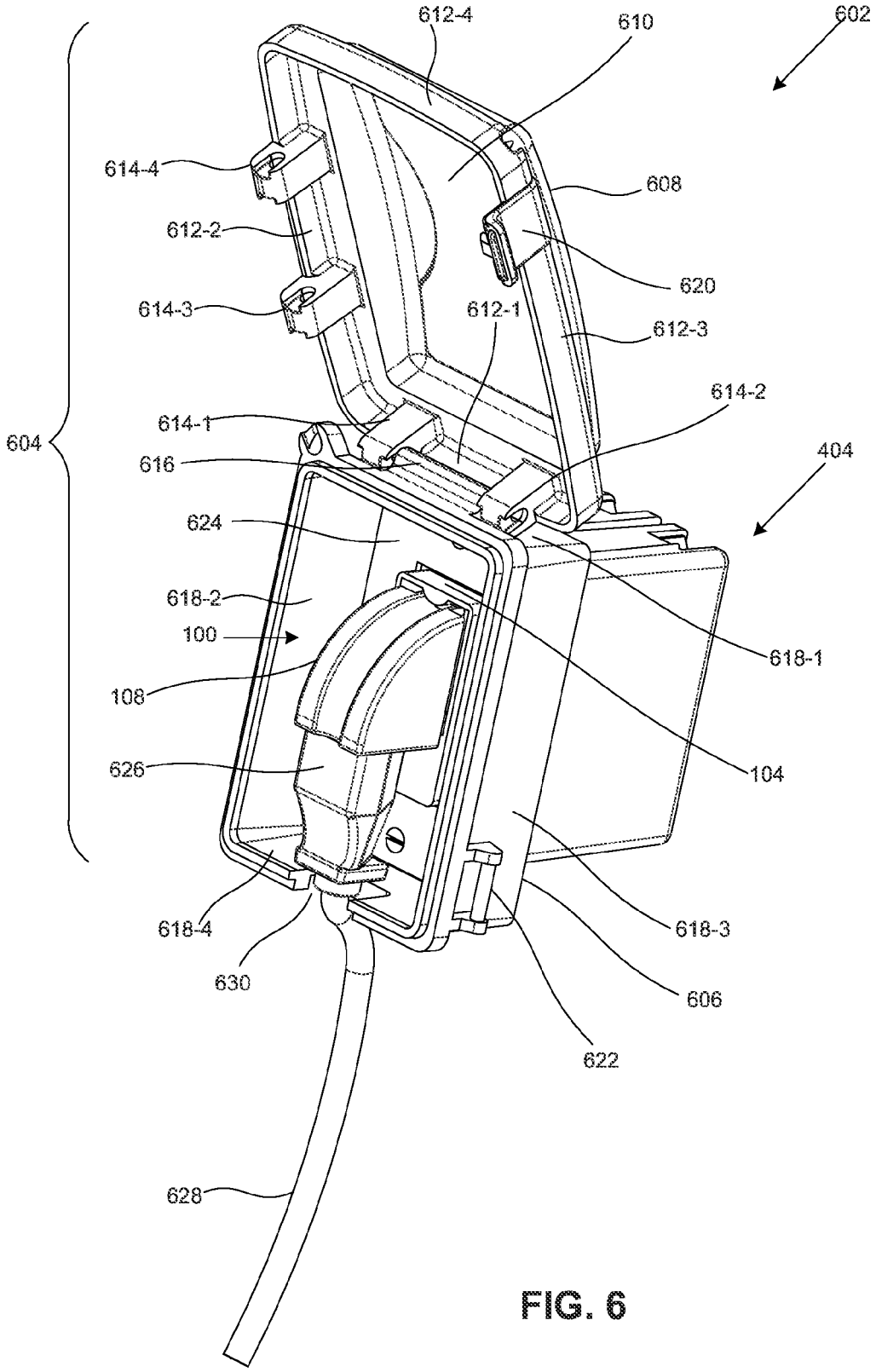
FIG. 6 is an isometric perspective view of the pivoting face receptacle installed in an electrical box according to another implementation.

FIG. 6 is an isometric perspective view of pivoting face receptacle 100 installed in an electrical box assembly 602 according to another implementation. Electrical box assembly 602 may include a while-in-use electrical box that can be installed indoors or outdoors. As shown, electrical box assembly 602 includes an electrical box 604 and electrical box 404. In FIG. 6, electrical box 404 is illustrated as being the same electrical box 404 of FIGS. 4 and 5. However, in other implementations, electrical box 404 may be different than that illustrated in FIG. 6.

Electrical box 604 includes housing 606 and cover 608. Housing 606, together with electrical box 404, may enclose pivoting face receptacle 100 when pivoting face receptacle 100 is installed in electrical box 604. As shown, receptacle module 104 (including female plug 108) may occupy the space enclosed by housing 606, while receptacle housing 104 (not shown in FIG. 6) may occupy the space enclosed by electrical box 404. Cover 608 provides a protective covering over the space enclosed by housing 606.

Cover 608 includes front panel 610, top wall 612-1, side wall 612-2, side wall 612-3, and bottom wall 612-4 that form a shallow box-like structure to couple/cover the open side of housing 606. Front panel 610 is perpendicular to walls 612, a number of which may include claws for coupling cover 608 to housing 606 when cover 608 is dosed over housing 606. In FIG. 6, top wall 612 includes claws 614-1 and 614-2, and side wall 612-2 includes claws 614-3 and 614-4. Each of the claws' fingers are pointed in the direction perpendicular to front panel 610, and may grip a bar-like member (e.g., bar-like member 616) attached to one of the walls 618-1 through 618-4 of housing, to act as a hinge. For example, in FIG. 6, claws 614-1 and 614-2 and bar-like member 616 on wall 618-1 act as a hinge, about which cover 608 may be rotated to open or close over housing 606.

For locking cover 608 to housing 606 when cover is closed over housing 606, wall 612-3 includes a snap-on/latch 620. When cover 608 is closed, latch 620 catches/latches a pin 622 on wall 618-3 of housing 606. To open cover 608, snap-on/latch 620 may be unhooked from pin 622 and cover 608 pulled open away from housing 606.

Housing 606 includes top wall 618-1, side wall 618-2, side wall 618-3, a bottom wall 618-4, and a rear panel 624. Walls 618, which are perpendicular to rear panel 624, and rear panel 624 enclose the space for receiving a plug 626, which plugs into female plug 108. Before cover 608 can be placed over housing 606, female plug 108 must be in open configuration/position, so that cord 628 attached to plug 626 is placed within an opening 630 in bottom wall 618-4. Thus, plug 626 and cord 628 do not obstruct cover 608 from closing over housing 606.

As described above, one of walls 618 (e.g., wall 618-3) may include a pin (e.g., pin 622), over which a snap-on/latch (e.g., snap-on/latch 620) may be hooked/latched. Although FIG. 6 shows electrical box 604 as having latch 620, pin 622, claws 614, and bar-like member 616 for coupling and/or opening and closing cover 608 over housing 606, in other implementations, different structures may be implemented to serve similar functions.

Figure 7:
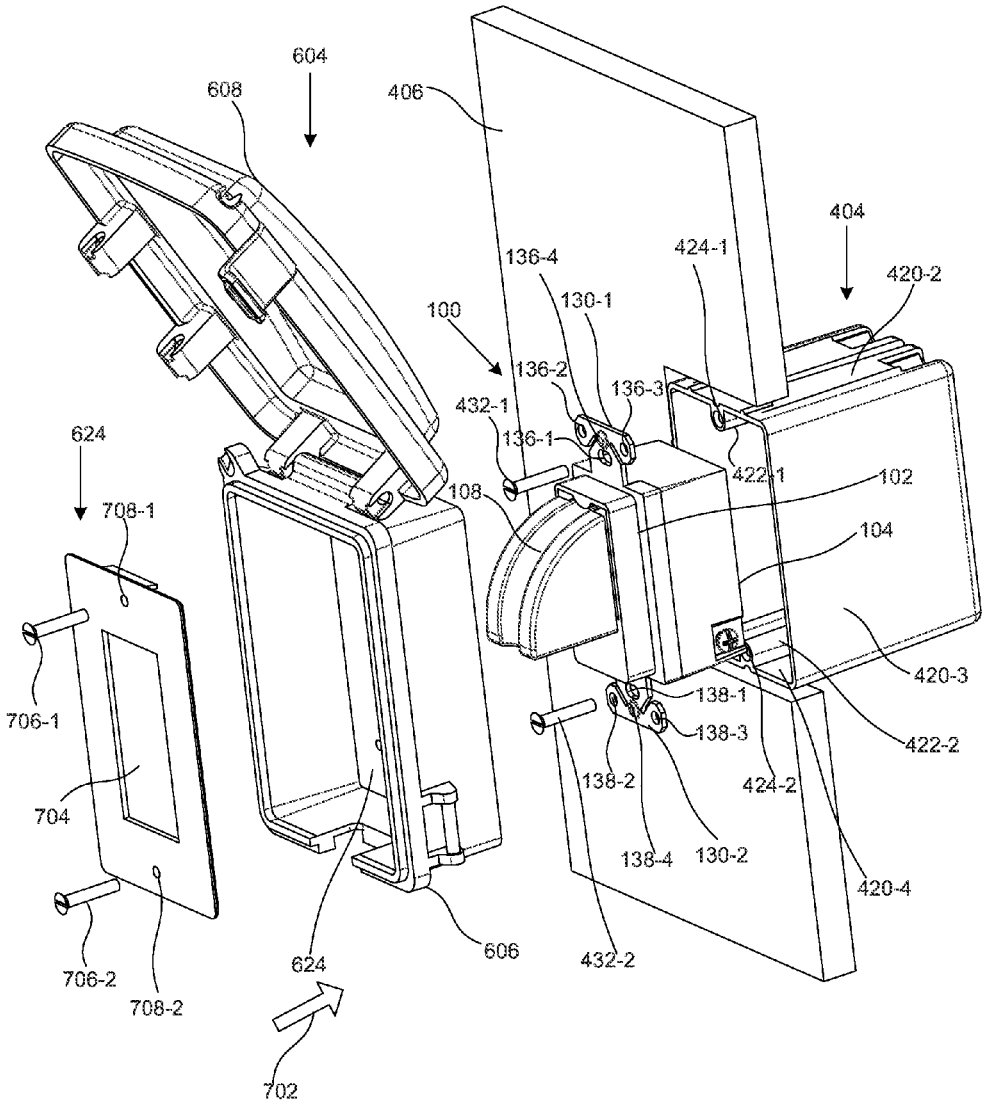
FIG. 7 is an exploded view of the pivoting face receptacle, the electrical box, and a wall in which the pivoting face receptacle and the electrical box are installed.

FIG. 7 is an exploded view of rear panel 624, electrical box 604, pivoting face receptacle 100, electrical box 404, and wall 406 in which the pivoting face receptacle 100 and the electrical box 404 are installed. Pivoting face receptacle 100 is configured and affixed to electrical box 104 and wall 406 in the manner described for FIG. 4.

To secure/affix electrical box 604 to pivoting face receptacle 100, rear panel 624 is removed from electrical box 604. With cover 608 of electrical box 604 open, electrical box 604 may be moved in the rearward direction (shown by arrow 702). Although not shown in FIG. 7, electrical box 604's rear wall 802 (FIG. 8) of housing 606 includes a widow/opening, and therefore, receptacle module 102 protrudes through the opening of rear wall 802 when the electrical box 604 abuts receptacle housing 104.

Rear panel 624 may then be placed rearward, in the direction of arrow 702, with receptacle module 102 poking through window 704 of rear panel 624. When rear panel 624 abuts rear wall 802 of electrical box 604, screws 706-1 and 706-2 may be inserted through top and bottom holes 708-1 and 708-2 in rear panel 624. Holes 708-1 and 708-2 are aligned with corresponding holes 136-4 and 138-4 on flanges 130-1 and 130-2 of pivoting face receptacle 100, respectively. Turning screws 706-1 and 706-2 causes the heads of screws 706-1 and 706-2 to press rear panel 624 against rear wall 702 of electrical box 604. Accordingly, electrical box 604 is affixed to pivoting face receptacle 100.

Figure 8:
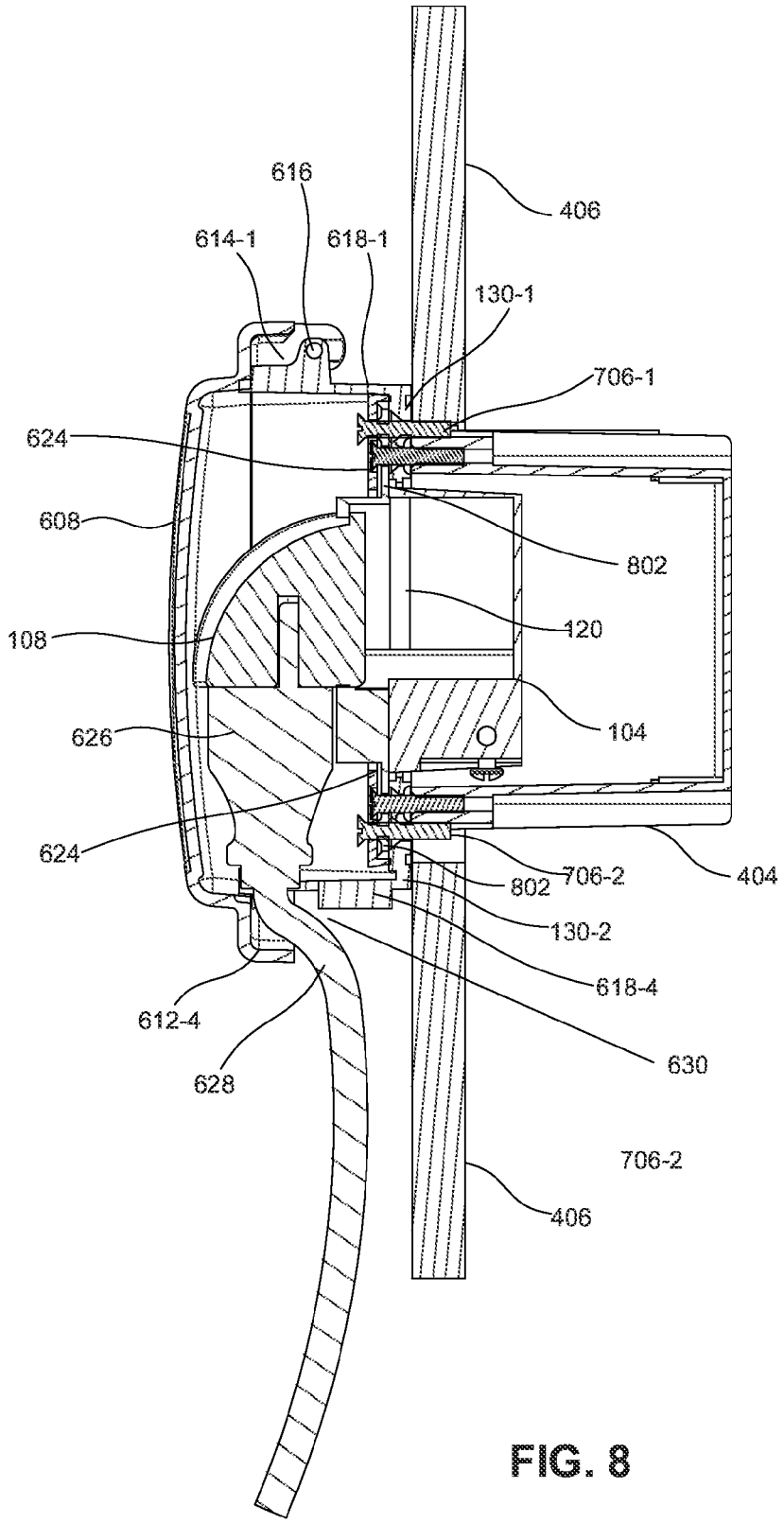
FIG. 8 is a cross-sectional side view of the pivoting face receptacle, the electrical box, and the wall in which the pivoting face receptacle and the electrical box are installed.

FIG. 8 is a cross-sectional side view of electrical box 604, pivoting face receptacle 100, electrical box 404, and wall 406 in which pivoting face receptacle 100 and electrical box 404 are installed. FIG. 8 shows cord 628 extending from electrical box 604 via opening 630. Because opening 630 is downward/sideways, moisture tends to move away (e.g., via cord 628) from within electrical box 604. This allows electrical box 604 to be installed and used outdoors as well as indoors, cleaned with wet cloth, mop, etc. If moisture were to accumulate within electrical box 604, the moisture could short electrical wires/contacts within pivoting face receptacle 100.

FIG. 8 shows rear wall 802, which is only partially shown in FIG. 7. In FIG. 8, rear wall 802 of electrical box 604 is sandwiched between rear panel 624 and front portion 120 of receptacle housing 104. FIG. 8 also shows screws 706-1 and 706-2 holding rear panel 624 and rear wall 802 to flanges 130-1 and 130-2.

In FIG. 8, female plug 108 is in the open position. If female plug 108 cannot be pivoted, female plug 108's face would be oriented horizontally (e.g., perpendicular to wall 406), and cover 608 would need to be much larger to accommodate plug 626 and cord 628.

As described above, pivoting face receptacle 100 includes female plug 108 that can rotate 90 degrees. Pivoting face receptacle 100 has many applications. When pivoting face receptacle 100 is mounted in a wall, female plug 108 can be pivoted. This eliminates the cable bend of the cord plugged into pivoting face receptacle 100, and prevents the cord from obstructing furniture placement. When pivoting face receptacle 100 is mounted within a while-in-use electrical box, female plug 108 eliminates the cable bend inside the while-in-use electrical box. Accordingly, the cover of the electrical box can be made unobtrusive.

Figure 9:
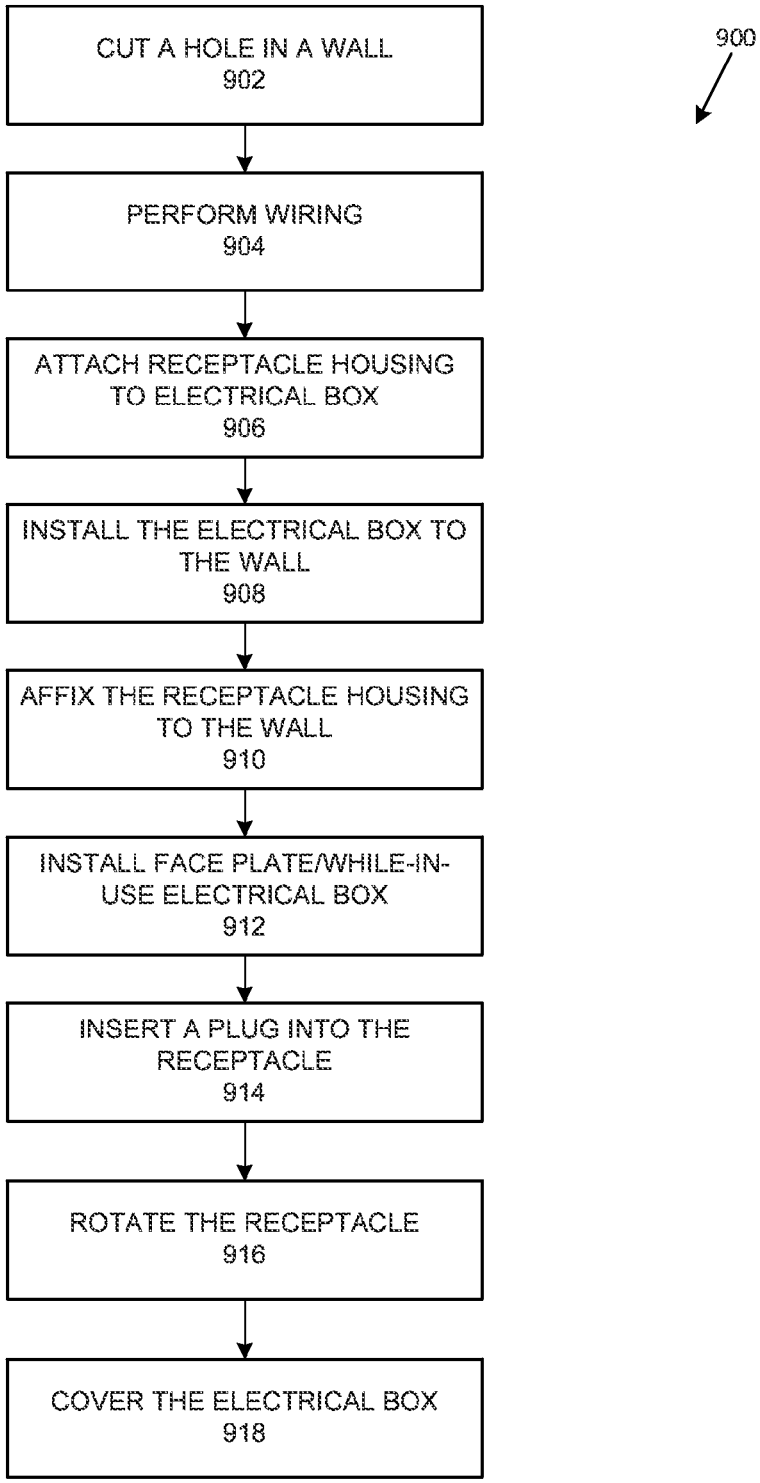
FIG. 9 is a flow diagram of an exemplary process that is associated with installing and using the pivoting face receptacle.

FIG. 9 is a flow diagram of an exemplary process 900 associated with installing and using pivoting face receptacle 100. As shown, process 900 may include cutting a hole 426 in wall 406, in which pivoting face receptacle 100 is to be installed (block 902). Hole 426 may be cut in the shape (e.g., rectangular) to fit electrical box 404 there into, in the desired orientation (e.g., vertical, horizontal, etc.).

Electrical wiring may be performed (block 904). For example, an electrician/installer may run electrical wires behind/through wall 406, and then through electrical box 404. The wires may then be attached to corresponding contact screws 128-1, 128-2, and/or 128-3 of pivoting face receptacle 100.

Receptacle housing 104 may be inserted into electrical box 404 and attached to electrical box (block 906). As discussed above, screws 432-1 and 432-2 may be run through holes 136-1 and 138-1, respectively, of flanges 130-1 and 130-2 of receptacle housing 104, and then to aligned holes 424-1 and 424-2 of electrical box 404. Screws 432-1 and 432-2 may then be turned to tightly couple receptacle housing 104 to electrical box 404.

Electrical box 404 may be installed in wall 406 (block 908). To install electrical box 404, electrical box 404 may be inserted into hole 426. Screws may be inserted through holes 136-2, 136-3, 138-2, and 138-4 in flanges 130-1 and 130-2 to wall 426, to affix receptacle housing 104 to wall 406 (block 910).

At block 912, either a face plate 402 or while-in-use electrical box 604 may be attached/mounted on pivoting face receptacle 100 (block 912). To mount face plate 402, screws 416-1 and 416-2 may be passed through holes 414-1 and 414-2 of face plate 402 and to holes 136-4 and 138-4 on flanges 130-1 and 130-2. To mount while-in-use electrical box 604, while-in-use electrical box 608 may be moved in the direction of arrow 702 (see FIG. 7) such that receptacle 108 appears, via a hole in rear wall 802 of while-in-use electrical box 604, in the space enclosed by housing 606 of while-in-use electrical box 604. Thereafter, screws 706-1 and 706-2 may be passed through rear panel 624 and rear wall 802 to holes 136-1 and 136-2, respectively, to couple while-in-use electrical box 604 to pivoting face receptacle 100/wall 426.

An electrical plug may be inserted into receptacle 100 in electrical box 604 (block 914). To use an electrical device/equipment, the plug of the device/equipment may be inserted into receptacle 100. Thereafter, receptacle 100 may be rotated 90 degrees, such that its face is in the desired direction (e.g., downward) (block 916). Rotating the receptacle 100 may allow the electrical plug and the cord, tier example, to be vertical and thus unobtrusive. Once the plug and cord are flat/parallel against/to rear panel 624 of electrical box 604 (and base 110 of receptacle 100), cover 608 may be placed over electrical box 604 and (block 918) and locked in place, via a snap-on/latch 620 (on cover 608) and pin 622 on housing 606.

The foregoing description of implementations provides illustration, but is not intended to be exhaustive or to limit the implementations to the precise form disclosed. Modifications and variations are possible in light of the above teachings or may be acquired from practice of the teachings. For example, in some implementations, receptacle module 102 may include receptacle 108 that pivots upward or sideways/horizontally (relative to the face of receptacle module 102) rather than downward. In addition, in some implementations, receptacle 108 may be configured to pivot less than 90 degrees or more than 90 degrees to allow for less or greater degree of freedom of rotation. The angle of pivoting, in some implementations, may be adjustable. Although FIGS. 4, 5, 7, and 8 show pivoting face receptacle 100 as being installed in the orientation with receptacle 108 facing downward in the pivoted configuration, pivoting face receptacle 100 may be installed in other orientations (e.g., horizontally, upside down, etc.).

In the above, while a series of blocks have been described with regard to the process illustrated in FIG. 9, the order of the blocks may be modified in other implementations. In addition, non-dependent blocks may represent blocks that can be performed in a different order.

Although different implementations have been described above, it is expressly understood that it will be apparent to persons skilled in the relevant art that the implementations may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the present application should be construed as critical or essential to the implementations described herein unless explicitly described as such. Also, as used herein, the article "a" is intended to include one or more items. Further, the phrase "based on" is intended to mean "based, at least in part, on" unless explicitly stated otherwise.

What is claimed is:

1. A pivoting face receptacle comprising:

a receptacle module including:

a hinge; and a receptacle attached to the hinge, wherein the receptacle is configured to pivot, about the hinge, from a retracted position in which a face of the receptacle is parallel to a front of the receptacle module, to an extended position in which the face of the receptacle is substantially perpendicular to the front of the receptacle module and protrudes from the face of the receptacle module; and a receptacle housing, having a front wall affixed to a rear wall of the receptacle module, that includes a plurality of contacts on exterior faces of the receptacle housing, wherein the receptacle housing is configured to receive the receptacle into a space enclosed by the receptacle housing when the receptacle is in the retracted position; and wherein the contacts are electrically coupled to the receptacle, wherein when in the retracted position, the face of the receptacle is open to and faces outside of the receptacle housing, such that an electrical connector external to the receptacle housing can be plugged into the receptacle in the retracted position, and wherein when in the extended position, the face of the receptacle is open to and faces outside of the receptacle housing, such that an electrical connector external to the receptacle housing can be plugged into the receptacle in the extended position.

2. The pivoting face receptacle of claim 1, wherein the plurality of contacts include at least two electrical contacts.

3. The pivoting face receptacle of claim 2, wherein each of the contacts is electrically coupled to one of holes, in the receptacle, for receiving prongs of a plug.

4. The pivoting face receptacle of claim 1, wherein the receptacle housing further includes:

flanges having holes, through which screws are inserted to:

affix the receptacle housing to an electrical box, wherein the electrical box is dimensioned to enclose the receptacle housing; and affix a face plate having a window to the front wall of the receptacle housing, wherein the affixed face plate covers the receptacle housing and the window exposes the front of the receptacle module.

5. The pivoting face receptacle of claim 4, wherein the screws are further inserted to:

affix the receptacle housing to a wall.

6. The pivoting face receptacle of claim 1, wherein the receptacle housing further includes:

flanges having holes, through which screws are inserted to:

affix the housing to an electrical box, wherein the electrical box is dimensioned to enclose the receptacle housing; and affix a plate, having a window, of a while-in-use electrical box to the front of the receptacle housing, wherein the plate covers the receptacle housing and the window exposes the front of the receptacle module to inside of the while-in-use electrical box.

7. The pivoting face receptacle of claim 6, wherein the while-in-use electrical box includes a cover that closes completely over a plug inserted into the receptacle when the receptacle is in the extended position.

8. The pivoting face receptacle of claim 1, wherein the receptacle includes contact holes for receiving one of:

a two-pronged plug; or a three pronged plug.

9. The pivoting face receptacle of claim 1, wherein the receptacle module includes:

a top wall, a first side wall, a second side wall, and a base that surround a space for the receptacle in the retracted position.

10. The pivoting face receptacle of claim 9, wherein a portion of the receptacle and a portion of the base form the hinge.

11. The pivoting face receptacle of claim 9, wherein the top wall includes a bump into the space for the receptacle, and wherein the receptacle includes a surface with a groove, to fit into the space for the receptacle.

12. The pivoting face receptacle of claim 1, wherein the receptacle module further includes:

another receptacle attached to the hinge, wherein the other receptacle is configured to pivot, about the hinge, from a retracted position in which a face of the other receptacle is parallel to the front of the receptacle module, to an extended position in which the face of the other receptacle is substantially perpendicular to the front the receptacle module and protrudes from the face of the receptacle module, and wherein the receptacle housing is further configured to:

receive the other receptacle into the space enclosed by the receptacle housing when the other receptacle is in the retracted position.

13. The pivoting face receptacle of claim 12, wherein the plurality of contacts on the exterior faces of the receptacle housing are electrically coupled to the other receptacle.

14. A system comprising:

a pivoting face receptacle comprising:

a receptacle module including:

a top wall, a first side wall, a second side wall, and a base that surround a space, wherein the base includes a first portion of a hinge; and a receptacle placed in the space, wherein the receptacle includes a second portion of the hinge, and wherein the receptacle is configured to pivot, about the hinge, from a closed configuration in which a face of the receptacle is parallel to a front of the receptacle module, to an open configuration in which the face of the receptacle is approximately 90 degrees relative to the front the receptacle module; and a receptacle housing whose front is affixed to a rear of the receptacle module, that includes a plurality of contacts on exterior faces of the receptacle housing, wherein the contacts are electrically coupled to the receptacle, wherein the receptacle housing is configured to receive the receptacle into a space enclosed by the receptacle housing when the receptacle is in the closed configuration, wherein when in the closed configuration, the face of the receptacle is open to and faces outside of the receptacle housing, such that an electrical connector external to the receptacle housing can be plugged into the receptacle in the closed configuration, and wherein when in the open position, the face of the receptacle is open to and faces outside of the receptacle housing, such that an electrical connector external to the receptacle housing can be plugged into the receptacle in the open configuration.

15. The system of claim 14, further comprising an electrical box and a face plate having an opening, wherein the receptacle housing further includes:

flanges having holes, through which screws are inserted to:

affix the receptacle housing to the electrical box, wherein the electrical box is dimensioned to enclose the receptacle housing; and affix the face plate to the front of the receptacle housing, wherein the affixed face plate covers the receptacle housing and the opening exposes the front the receptacle module.

16. The system of claim 14, further comprising a while-in-use electrical box, wherein the receptacle housing further includes:

flanges having holes, through which screws are inserted to:

affix a plate, having an opening, of a while-in-use electrical box to the front of the receptacle housing, wherein the plate covers the receptacle housing and the opening exposes the front of the receptacle module and the receptacle to inside of the while-in-use electrical box.

17. The system of claim 16, wherein the while-in-use electrical box includes a cover that closes completely over a plug inserted into the receptacle when the receptacle is the open configuration.

18. The system of claim 14, wherein the receptacle includes contact holes for receiving one of:

a two-pronged plug; or a three pronged plug.

19. A method comprising:

running wires through an electrical box;

attaching the wires to a plurality of contacts of a pivoting face receptacle wherein the pivoting face receptacle comprises:

a receptacle module including:

a hinge; and a receptacle attached to the hinge, wherein the receptacle is configured to pivot, about the hinge, from a retracted position in which a face of the receptacle is parallel to a front of the receptacle module, to an extended position in which the face of the receptacle is substantially perpendicular to the front of the receptacle module and protrudes from the face of the receptacle module; and a receptacle housing, having a front wall affixed to a rear wall of the receptacle module, that includes the plurality of contacts on exterior faces of the receptacle housing, wherein the receptacle housing is configured to receive the receptacle into a space enclosed by the receptacle housing when the receptacle is in the retracted position; and wherein the contacts are electrically coupled to the receptacle;

placing the pivoting face receptacle inside the electrical box;

affixing the electrical box to the pivoting face receptacle; and installing the pivoting face receptacle and the electrical box to a wall, wherein when in the retracted position, the face of the receptacle is open to and faces outside of the receptacle housing, such that an electrical connector external to the receptacle housing can be plugged into the receptacle in the retracted position, and wherein when in the extended position, the face of the receptacle is open to and faces outside of the receptacle housing, such that an electrical connector external to the receptacle housing can be plugged into the receptacle in the extended position.

20. The method of claim 19, further comprising:

affixing one of a face plate or a second electrical box to the pivoting face receptacle.

21. The method of claim 19, further comprising cutting a hole in the wall, wherein installing the pivoting face receptacle and the electrical box to the wall includes:

inserting the electrical box with the pivoting face receptacle placed therein, into the hole;

affixing the pivoting face receptacle to the wall.

* * * * *